US005803694A

United States Patent [19]

Steele

[11] Patent Number: 5,803,694

[45] Date of Patent: Sep. 8, 1998

[54] PORTABLE TREE PLATFORM ELEVATED VIA A WINCH

[76] Inventor: Jackie R. Steele, R.R. #5, Bloomfield, Ind. 47424

[21] Appl. No.: 775,250

[22] Filed: Dec. 30, 1996

[51] Int. Cl.[6] ..... B66C 23/60

[52] U.S. Cl. ..... 414/23; 135/901; 43/1

[58] Field of Search ..... 414/23; 43/1; 135/90, 135/901; 182/187

[56] References Cited

U.S. PATENT DOCUMENTS

| | | | |
|---|---|---|---|
| 610,691 | 9/1898 | Ryder | 414/23 |
| 791,968 | 6/1905 | Wiley | 414/23 |
| 2,281,713 | 5/1942 | Pyeatt | 414/23 |
| 3,115,256 | 12/1963 | Sears, Sr. | 414/23 |
| 4,239,188 | 12/1980 | Hobbs | 414/23 |
| 4,412,398 | 11/1983 | Harmon | 43/1 |
| 4,840,252 | 6/1989 | Hucks, Jr. | 182/187 |
| 5,316,104 | 5/1994 | Amacker | 182/187 |
| 5,371,966 | 12/1994 | Hall | 43/1 |
| 5,476,352 | 12/1995 | Culbertson et al. | 414/23 |
| 5,613,512 | 3/1997 | Bean | 135/90 |

*Primary Examiner*—Karen M. Young
*Assistant Examiner*—Douglas Hess

[57] ABSTRACT

A portable tree platform elevated via a winch including a planar platform with at least one support rod coupled at a first end thereof to the platform and extending upwardly therefrom. A pair of wheels are rotatably coupled to the periphery of the platform adjacent the support rod such that the platform may be easily transported in a manner similar to a cart. Further provided is a winch unit including a spool and a motor connected to a battery. The motor is adapted for effecting the gathering of the cable on the spool upon the actuation thereof in a first mode of operation and further effecting the dispensing of the cable from the spool upon the actuation thereof in a second mode of operation. By this structure, an end of the cable may be fixed in an upper extent of a tree such that upon the actuation of the motor in the first mode of operation, the platform is elevated.

9 Claims, 3 Drawing Sheets

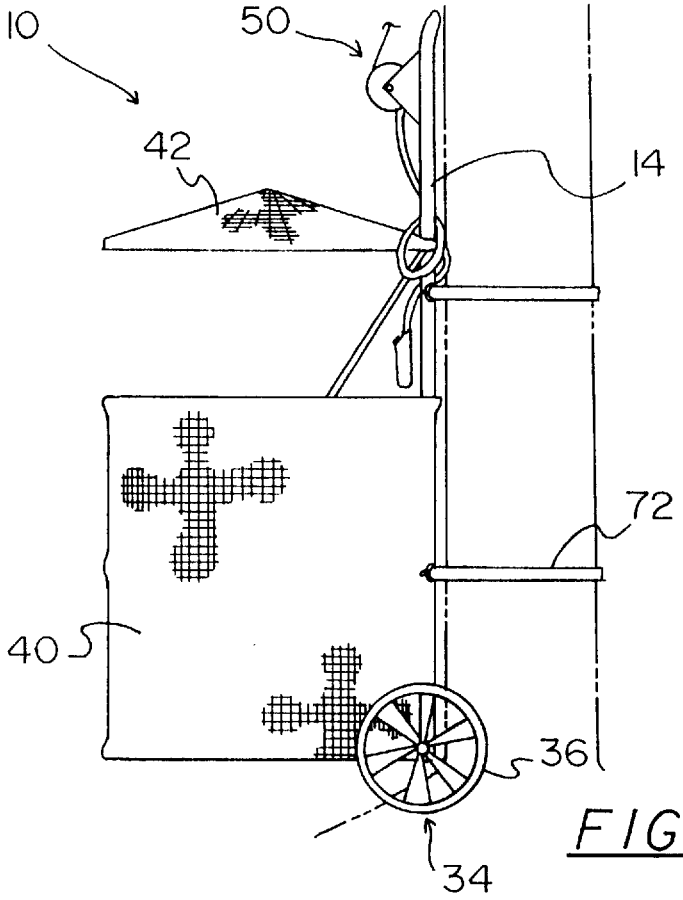
FIG. 1
FIG. 2
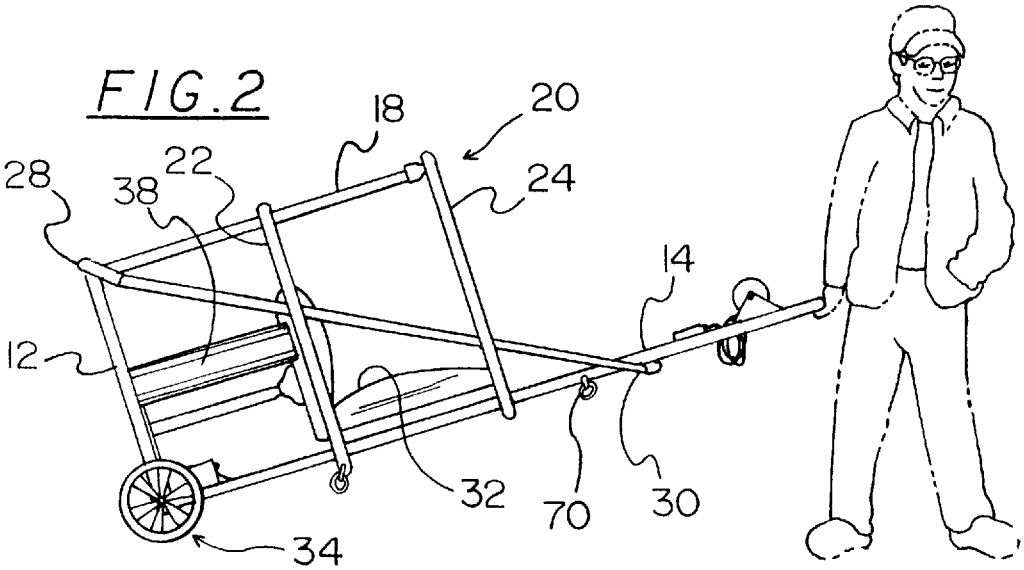

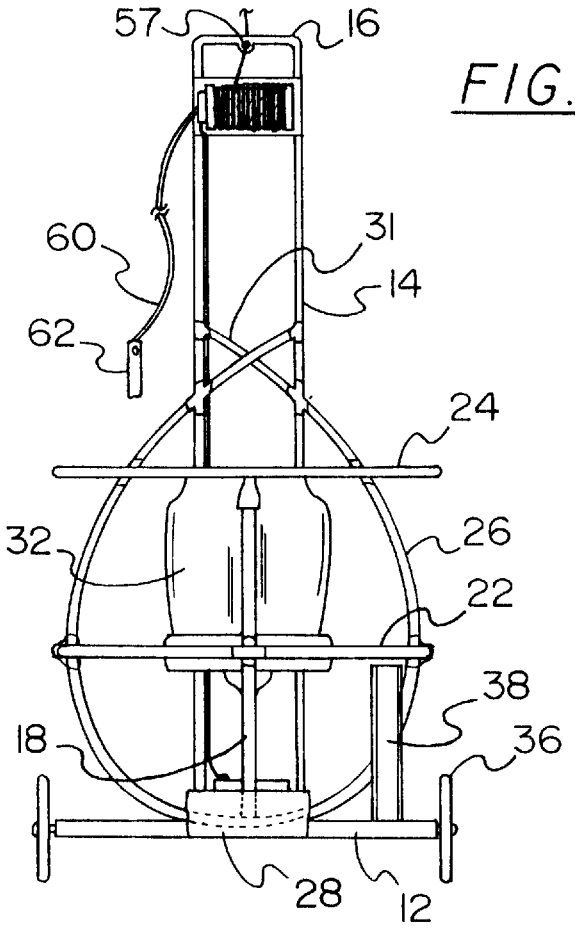
FIG. 3
FIG. 4
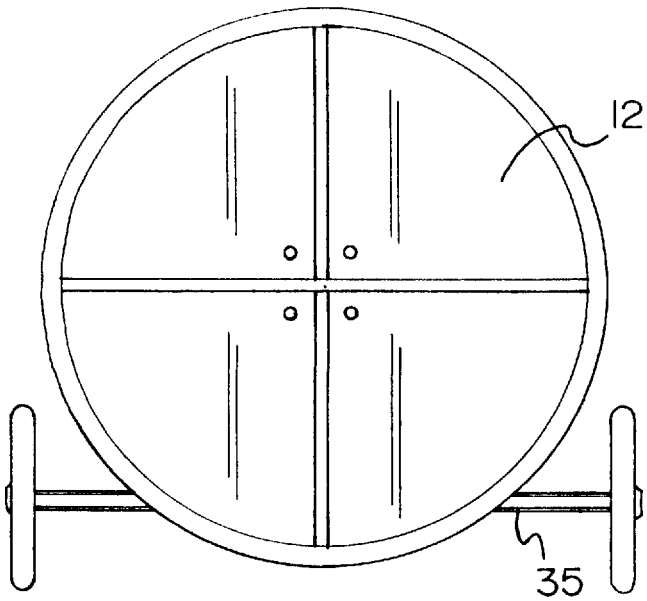

PORTABLE TREE PLATFORM ELEVATED VIA A WINCH

BACKGROUND OF THE INVENTION

1. Field of the Invention

The present invention relates to a portable tree platform elevated via a winch and more particularly pertains to providing a platform which is both capable of being elevated within a tree via a winch and further transported on wheels in a manner similar to that in which a cart is transported.

2. Description of the Prior Art

The use of tree platforms is known in the prior art. More specifically, tree platforms heretofore devised and utilized for hunting purposes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,371,966 to Hall; U.S. Pat. No. 4,412,398 to Harmon; U.S. Pat. No. 4,719,716 to Chrisley, Jr.; U.S. Pat. No. 5,037,052 to Crisp et al.; U.S. Pat. No. 4,364,193 to Visco; and U.S. Pat. No. Des. 354,143 to Floyd, Jr.

In this respect, the portable tree platform elevated via a winch according to the present invention substantially departs from the conventional concepts and designs of the prior art, and in so doing provides an apparatus primarily developed for the purpose of providing a platform which is both capable of being elevated within a tree via a winch and further transported on wheels in a manner similar to that in which a cart is transported.

Therefore, it can be appreciated that there exists a continuing need for a new and improved portable tree platform elevated via a winch which can be used for providing a platform which is both capable of being elevated within a tree via a winch and further transported on wheels in a manner similar to that in which a cart is transported. In this regard, the present invention substantially fulfills this need.

SUMMARY OF THE INVENTION

In view of the foregoing disadvantages inherent in the known types of tree platforms now present in the prior art, the present invention provides an improved portable tree platform elevated via a winch. As such, the general purpose of the present invention, which will be described subsequently in greater detail, is to provide a new and improved portable tree platform elevated via a winch which has all the advantages of the prior art and none of the disadvantages.

To attain this, the present invention essentially comprises a planar platform with a circular configuration having a top face and a bottom face. As shown in FIGS. 3 & 5, the platform includes a pair of parallel closely spaced rear support rods coupled at a lower end thereof to a periphery of the platform and extended upwardly therefrom. The rear support rods have an interconnection member coupled perpendicularly between upper ends thereof. A front support rod is coupled at a lower end thereof to the periphery of the platform in a position diametrically opposite the rear support rods. It should be noted that the front support rod extends upward half a distance the rear support rods extend upwardly. Further provided is a railing assembly including a first annular railing with a diameter equal to that of the platform. The first annular railing is concentrically coupled with respect to the platform between the rear support rods and a midpoint of the front support rod. Also included is a second annular railing also having a diameter equal to that of the platform. As best shown in FIG. 3, the second annular railing is concentrically coupled with respect to the platform between the rear support rods and a top end of the front support rod. The railing assembly further includes an elliptical railing. Such elliptical railing has a first end thereof which resides adjacent to a first foci of the elliptical railing coupled to a base of the front support rod. The elliptical railing further has a second end which resides adjacent to a second foci of the elliptical railing coupled to the rear support rods above the second annular railing. As shown in FIG. 3, a seat is included with a bottom horizontally oriented portion and an upper vertically oriented portion. The seat is rotatably coupled to the platform at a center thereof via a post. For affording mobility, a wheel assembly is provided with a horizontal axis coupled at a central extent thereof to the periphery of the platform adjacent the rear support rods. Rotatably coupled to opposite ends of the axis is a pair of wheels. With continuing reference to FIG. 3, a weapon holder is included with a cylindrical configuration. The weapon holder has a bottom face coupled to the platform adjacent the seat and a periphery extending upwardly therefrom defining an interior space and a top opening for allowing the storage of a weapon. Also included is a canvas covering adapted to be situated about the first annular ring and the second annular ring. Note FIG. 1. The canvas covering extends between the periphery of the platform and the second annular ring. Associated therewith is an overhead covering having a conical orientation with a diameter equal to that of the platform. The overhead covering is coupled at a periphery thereof to the rear support rods and extended outwardly therefrom in concentric relationship with the platform. Ideally, the canvas covering and overhead covering have camouflage print thereon. For allowing the platform to be elevated in a tree, a winch unit is provided with a rectangular mounting plate coupled between the upper ends of the rear support rods. A pair of tabs are coupled to and extending outwardly from the mounting plate with a pair of axially aligned apertures formed therein. A further component of the winch unit is a spool rotatably coupled between the tabs about a horizontal axis via the apertures with a cable wrapped thereon. A motor is connected to a battery for effecting the gathering of the cable on the spool upon the actuation thereof in a first mode of operation. Upon the actuation of the motor in a second mode of operation, it is adapted for effecting the dispensing of the cable from the spool. By this structure, an end of the cable may be fixed in an upper extent of a tree such that upon the actuation of the motor in the first mode of operation, the platform may be elevated. Finally, a pair of eyelets are coupled to the rear support rods for allowing straps to be threaded therethrough. Such straps may be secured to the tree upon the platform reaching a desired elevation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable tree platform elevated via a winch which has all the advantages of the prior art tree platforms and none of the disadvantages.

It is another object of the present invention to provide a new and improved portable tree platform elevated via a winch which may be easily and efficiently manufactured and marketed.

It is a further object of the present invention to provide a new and improved portable tree platform elevated via a winch which is of a durable and reliable construction.

An even further object of the present invention is to provide a new and improved portable tree platform elevated via a winch which is susceptible of a low cost of manufacture with regard to both materials and labor, and which accordingly is then susceptible of low prices of sale to the consuming public, thereby making such portable tree platform elevated via a winch economically available to the buying public.

Still yet another object of the present invention is to provide a new and improved portable tree platform elevated via a winch which provides in the apparatuses and methods of the prior art some of the advantages thereof, while simultaneously overcoming some of the disadvantages normally associated therewith.

Still another object of the present invention is to provide a platform which is both capable of being elevated within a tree via a winch and further transported on wheels in a manner similar to that in which a cart is transported.

Lastly, it is an object of the present invention to provide a new and improved portable tree platform elevated via a winch including a planar platform with at least one support rod coupled at a first end thereof to the platform and extending upwardly therefrom. A pair of wheels are rotatably coupled to the periphery of the platform adjacent the support rod such that the platform may be easily transported in a manner similar to a cart. Further provided is a winch unit including a spool and a motor connected to a battery. The motor is adapted for effecting the gathering of the cable on the spool upon the actuation thereof in a first mode of operation and further effecting the dispensing of the cable from the spool upon the actuation thereof in a second mode of operation. By this structure, an end of the cable may be fixed in an upper extent of a tree such that upon the actuation of the motor in the first mode of operation, the platform is elevated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the portable tree platform elevated via a winch constructed in accordance with the principles of the present invention.

FIG. 2 is an illustration of the present invention without the canvas covering and overhead covering.

FIG. 3 is a front elevational view of the present invention.

FIG. 4 is a bottom view of the present invention.

Similar reference characters refer to similar parts throughout the several views of the drawings.

DESCRIPTION OF THE PREFERRED EMBODIMENT

Figure 5:
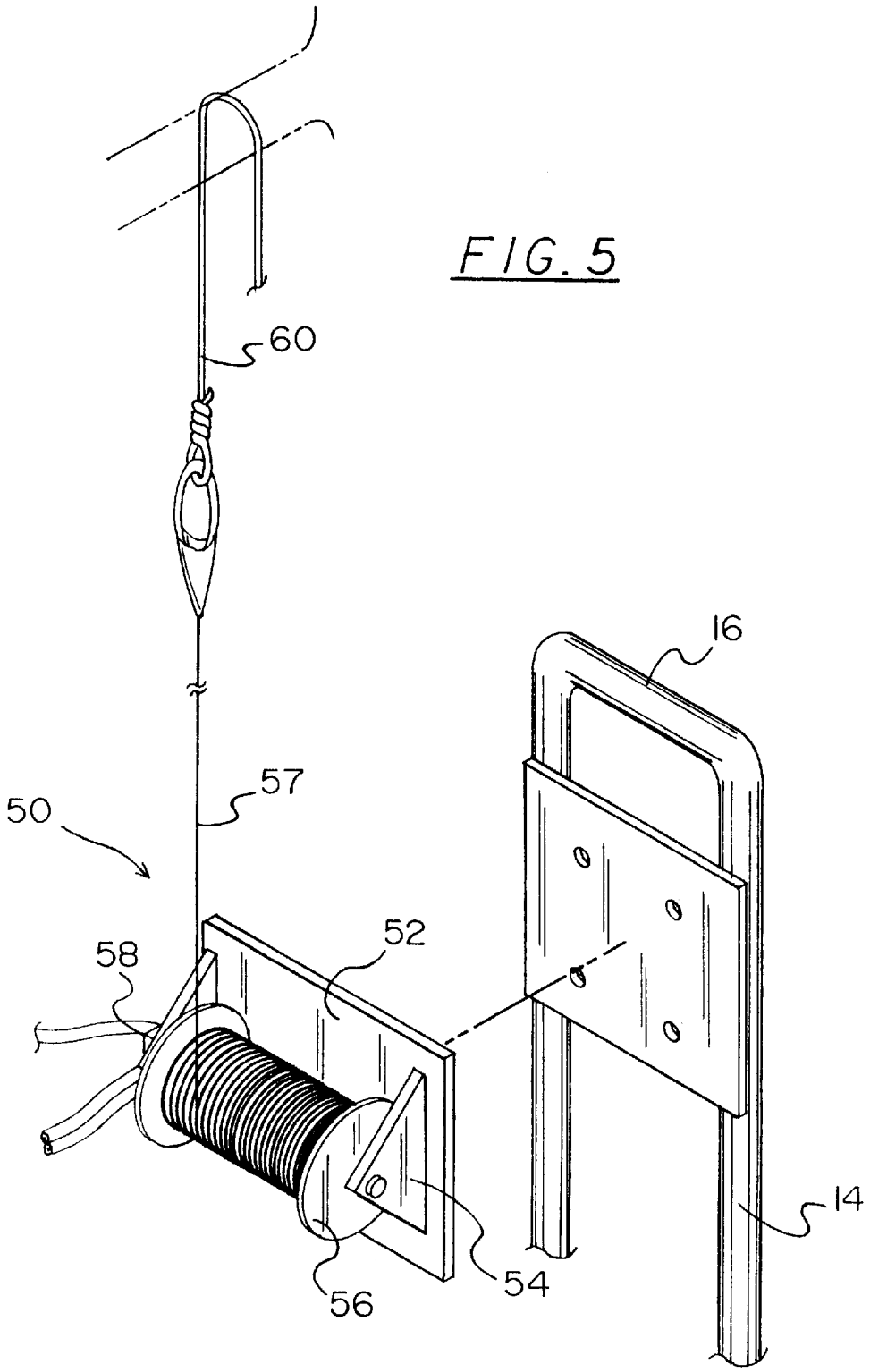
FIG. 5 is an exploded view of the winch unit of the present invention.

With reference now to the drawings, and in particular to FIG. 1 thereof, a new and improved portable tree platform elevated via a winch embodying the principles and concepts of the present invention and generally designated by the reference numeral 10 will be described.

The present invention, the new and improved portable tree platform elevated via a winch, is comprised of a plurality of components. Such components in their broadest context include a platform, rail assembly, seat, weapon holder, wheel assembly, winch unit, and canvas covering and overhead covering. Such components are individually configured and correlated with respect to each other so as to attain the desired objective.

More specifically, it will be noted that the system 10 of the present invention includes a planar platform 12 with a circular configuration having a top face and a bottom face. For affording additional stability a pair of reinforcing members 13 are attached to the bottom face of the platform, as can be seen in FIG. 4. As shown in FIGS. 3 & 5, the platform includes a pair of parallel closely spaced rear support rods 14 coupled at a lower end thereof to a periphery of the platform and extended upwardly therefrom. The rear support rods have an interconnection member 16 integrally coupled perpendicularly between upper ends thereof. A front support rod 18 is coupled at a lower end thereof to the periphery of the platform in a position diametrically opposite the rear support rods. It should be noted that the front support rod extends upward half a distance the rear support rods extend upwardly.

Further provided is a railing assembly 20 including a first annular railing 22 with a diameter equal to that of the platform. The first annular railing is concentrically coupled with respect to the platform between the rear support rods and a midpoint of the front support rod. Also included is a second annular railing 24 also having a diameter equal to that of the platform. As best shown in FIG. 3, the second annular railing is concentrically coupled with respect to the platform between the rear support rods and a top end of the front support rod. It should be noted that the first and second annular railings reside in separate horizontal planes. The railing assembly further includes an elliptical railing 26. Such elliptical railing has a first end 28 thereof which resides adjacent to a first foci of the elliptical railing. The first end 28 is coupled to a base of the front support rod. The elliptical railing further has a second end 30 which resides adjacent to a second foci of the elliptical railing. The second end 30 is coupled to the rear support rods above the second annular railing. As shown in FIG. 3, sides of the elliptical railing are coupled to both the first and second annular railing. Further, the second end of the elliptical railing has a pair of extensions 31 which form an "X" shaped configuration coupled between the rear support rods.

As shown in FIG. 3, a seat 32 is included with a bottom horizontally oriented portion and an upper vertically oriented portion. The bottom portion of the seat is rotatably coupled to the platform at a center thereof via a post.

For affording mobility, a wheel assembly 34 is provided with a horizontal axis 35 coupled at a central extent thereof to the periphery of the platform adjacent the rear support rods. Rotatably coupled to opposite ends of the axis is a pair of wheels 36. As shown in FIG. 2, the interconnection member between the rear support rails may be utilized as a handle so that the platform may be transported on the wheels.

With continuing reference to FIG. 3, a weapon holder 38 is included with a cylindrical configuration. The weapon holder has a bottom face coupled to the platform adjacent the seat and a periphery extending upwardly therefrom defining an interior space and a top opening for allowing the storage of a weapon.

Also included is a canvas covering 40 adapted to be situated about the entire first annular ring and the second annular ring. Note FIG. 1. The canvas covering extends between the periphery of the platform and the second annular ring.

Associated therewith is an overhead covering 42 having a conical orientation with a diameter equal to that of the platform. The overhead covering is coupled at a periphery thereof to the rear support rods and extended outwardly therefrom in concentric relationship with the platform. Ideally, the canvas covering and overhead covering have camouflage print thereon.

For allowing the platform to be elevated in a tree, a winch unit 50 is provided with a rectangular mounting plate 52 coupled between the upper ends of the rear support rods. See FIG. 5. A pair of tabs 54 are coupled to and extending outwardly from the mounting plate with a pair of axially aligned apertures formed therein. A further component of the winch unit is a spool 56 rotatably coupled between the tabs about a horizontal axis via the apertures with a cable 57 wrapped thereon. As shown in FIG. 3, the cable is preferably threaded through an eyelet 57 formed in the interconnection member between the rear support rods. A motor 58 is connected to a battery for effecting the gathering of the cable on the spool upon the actuation thereof in a first mode of operation. Upon the actuation of the motor in a second mode of operation, it is adapted for effecting the dispensing of the cable from the spool. By this structure, an end of the cable may be fixed in an upper extent of a tree such that upon the actuation of the motor in the first mode of operation, the platform may be elevated.

Various methods may be employed to fix the end of the cable in an upper extent of the tree. The preferred method utilizes an auxiliary rope 60, as shown in FIG. 3 & 5, which is coupled at a first end thereof to the end of the cable and a second end thereof to a weight 62. In use, the weight may be thrown about a branch such that the rope may be employed to raise the cable proximal to the branch whereat the second end of the rope may be secured to a ground structure.

Finally, a pair of eyelets 70 are coupled to the rear support rods for allowing straps 72 to be threaded therethrough. Such straps may be secured to the tree upon the platform reaching a desired elevation. Pile type fasteners, buckles or the like may be utilized to afford such securement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable tree platform for elevating via a winch comprising, in combination:

a planar platform with a circular configuration having a top face and a bottom face, the platform having a pair of parallel closely spaced rear support rods coupled at a lower end thereof to a periphery of the platform and extended upwardly therefrom, the rear support rods having an interconnection member perpendicularly between upper ends thereof, the planar platform further having a front support rod coupled at a lower end thereof to the periphery in a position diametrically opposite the rear support rods, wherein the front support rod extends upward half a distance that the rear support rods extend upwardly;

a railing assembly including a first annular railing with a diameter equal to that of the platform, the first annular railing being concentrically coupled with respect to the platform between the rear support rods and a midpoint of the front support rod, the railing assembly further including a second annular railing also having a diameter equal to that of the platform, the second annular railing being concentrically coupled with respect to the platform between the rear support rods and a top end of the front support rod, the railing assembly further including an elliptical railing with a first end thereof which resides adjacent to a first foci of the elliptical railing coupled to a base of the front support rod and a second end which resides adjacent to a second foci of the elliptical railing coupled to the rear support rods above the second annular railing;

a seat with a bottom horizontally oriented portion and an upper vertically oriented portion, the seat rotatably coupled to the platform at a center thereof via a post;

a wheel assembly including a horizontal axis coupled at a central extent thereof to the periphery of the platform adjacent the rear support rods, the wheel assembly having a pair of wheels rotatably coupled to opposite ends of the axis;

a weapon holder having a cylindrical configuration with a bottom face coupled to the platform adjacent the seat and a periphery extending upwardly therefrom defining an interior space and a top opening for allowing the storage of a weapon;

a canvas covering adapted to be situated about the first annular ring and the second annular ring and extending between the periphery of the platform and the second annular ring, the canvas covering having camouflage print thereon;

an overhead covering having a conical orientation with a diameter equal to that of the platform, the overhead covering being coupled at a periphery thereof to the rear support rods and extending outwardly therefrom in concentric relationship with the platform, the overhead covering having camouflage print thereon;

a winch unit including a rectangular mounting plate coupled between the upper ends of the rear support rods, a pair of tabs coupled to and extending outwardly from the mounting plate with a pair of axially aligned apertures formed therein, a spool rotatably coupled between the tabs about a horizontal axis via the apertures with a cable wrapped thereon, and a motor connected to a battery for effecting the gathering of the cable on the spool upon the actuation thereof in a first mode of operation and further effecting the dispensing of the cable from the spool upon the actuation thereof in a second mode of operation, whereby an end of the cable may be fixed in an upper extent of a tree such that upon the actuation of the motor in the first mode of operation, the platform may be elevated; and a pair of eyelets coupled to the rear support rods for allowing straps to be threaded therethrough and secured to the tree upon the platform reaching a desired elevation.

2. A portable tree platform for elevating via a winch comprising:

a planar platform with at least one support means; and a winch unit including a spool means and a motor connected to a battery, the spool means connected to the support means for effecting the gathering of cable on the spool means upon the actuation thereof in a first mode of operation and further effecting the dispensing of the cable from the spool means upon the actuation thereof in a second mode of operation, whereby an end of the cable may be fixed in an upper extent of a tree such that upon the actuation of the motor in the first mode of operation, the platform may be elevated;

wherein the support means of the platform includes a pair of parallel closely spaced rear support rods coupled at a lower end thereof to a periphery of the platform and extended upwardly therefrom, the rear support rods having an interconnection member perpendicularly between upper ends thereof, the planar platform further having a front support rod coupled at a lower end thereof to the periphery in a position diametrically opposite the rear support rods, wherein the front support rod extends upward half a distance the rear support rods extend upwardly.

3. A portable tree platform for elevating via a winch as set forth in claim 2 and further including a seat with a bottom horizontally oriented portion and an upper vertically oriented portion, the seat rotatably coupled to the platform at a center thereof via a post.

4. A portable tree platform for elevating via a winch as set forth in claim 2 and further including a railing assembly including a first annular railing with a diameter equal to that of the platform, the first annular railing being concentrically coupled with respect to the platform between the rear support rods and a midpoint of the front support rod, the railing assembly further including a second annular railing also having a diameter equal to that of the platform, the second annular railing being concentrically coupled with respect to the platform between the rear support rods and a top end of the front support rod, the railing assembly further including an elliptical railing with a first end thereof which resides adjacent to a first foci of the elliptical railing coupled to a base of the front support rod and a second end which resides adjacent to a second foci of the elliptical railing coupled to the rear support rods above the second annular railing.

5. A portable tree platform for elevating via a winch as set forth in claim 4 and further including a canvas covering adapted to be situated about the first annular ring and the second annular ring and extending between the periphery of the platform and the second annular ring, the canvas covering having camouflage print thereon.

6. A portable tree platform for elevating via a winch as set forth in claim 2 and further providing a wheel assembly including a horizontal axis coupled at a central extent thereof to the periphery of the platform adjacent the rear support rods, the wheel assembly having a pair of wheels rotatably coupled to opposite ends of the axis.

7. A portable tree platform for elevating via a winch as set forth in claim 3 and further including an overhead covering having a conical orientation with a diameter equal to that of the platform, the overhead covering being coupled at a periphery thereof to the rear support rods and extending outwardly therefrom in concentric relationship with the platform, the overhead covering having camouflage print thereon.

8. A portable tree platform for elevating via a winch as set forth in claim 2 and further including a pair of eyelets coupled to the rear support rods for allowing straps to be threaded therethrough and secured to the tree upon the platform reaching a desired elevation.

9. A portable tree platform for elevating via a winch comprising:

a planar platform with at least one support means;

a winch unit including a spool means and a motor connected to a battery, the spool means connected to the support means for effecting the gathering of cable on the spool means upon the actuation thereof in a first mode of operation and further effecting the dispensing of the cable from the spool means upon the actuation thereof in a second mode of operation, whereby an end of the cable may be fixed in an upper extent of a tree such that upon the actuation of the motor in the first mode of operation, the platform may be elevated; and a weapon holder having a cylindrical configuration with a bottom face coupled to the platform and a periphery extending upwardly therefrom defining an interior space and a top opening for allowing the storage of a weapon.

* * * * *